US005179751A

United States Patent [19]

Wiedeck

[11] Patent Number: 5,179,751

[45] Date of Patent: Jan. 19, 1993

[54] VEHICLE FOR LAYING DISMOUNTABLE BRIDGES

[75] Inventor: Hans N. Wiedeck, Mühlheim/Ruhr, Fed. Rep. of Germany

[73] Assignee: Krupp Industrietechnik GmbH, Duisburg, Fed. Rep. of Germany

[21] Appl. No.: 671,750

[22] PCT Filed: Oct. 20, 1989

[86] PCT No.: PCT/EP89/01258

§ 371 Date: May 2, 1991

§ 102(e) Date: May 2, 1991

[87] PCT Pub. No.: WO90/05216

PCT Pub. Date: May 17, 1990

[30] Foreign Application Priority Data

Nov. 2, 1988 [DE] Fed. Rep. of Germany ..... 3837122

[51] Int. Cl.[5] ..... E01D 15/12; E01D 21/00

[52] U.S. Cl. ..... 14/2.4; 296/37.7

[58] Field of Search ..... 14/1, 2, 2.4, 2.6; 296/100, 140, 37.7

[56] References Cited

U.S. PATENT DOCUMENTS 4,493,122 1/1985 Echtler et al. ..... 14/2.4

FOREIGN PATENT DOCUMENTS 0256446 8/1987 European Pat. Off. .
2929208 2/1981 Fed. Rep. of Germany .
3426023 1/1986 Fed. Rep. of Germany .
3517724 3/1986 Fed. Rep. of Germany .
3535640 4/1987 Fed. Rep. of Germany .
3625321 6/1987 Fed. Rep. of Germany .

*Primary Examiner*—Ramon S. Britts
*Assistant Examiner*—Nancy P. Connolly
*Attorney, Agent, or Firm*—Spencer, Frank & Schneider

[57] ABSTRACT

A vehicle for laying movable bridges formed of bridge sections which can be coupled end-to-end on the vehicle. The vehicle has at one end a laying device for displacing and laying the assembled bridge. Spaced longitudinally from the laying device is a pick-up device for picking up and supporting a bridge section so as to permit coupling of bridge sections at a same height with respect to the laying device. The pick-up device can support a plurality of the bridge sections in a coupled state, and while so supported, the coupled bridge sections can be displaced relative to the pick-up device in a direction away from the laying device. The pick-up device is spaced from the laying device by a distance which is dimensioned so that at least one bridge section can be inserted between bridge sections supported by the laying device and the pick-up device.

19 Claims, 5 Drawing Sheets

VEHICLE FOR LAYING DISMOUNTABLE BRIDGES

BACKGROUND OF THE SPECIFICATION

The invention relates to a vehicle for laying dismountable bridges, of the type provided with a laying device for displacing and laying a bridge which can be assembled on the vehicle. Such a vehicle is provided, at a longitudinally opposite end of the vehicle, with a pick-up device for supporting a bridge section at the same height at which the laying device supports bridge sections, so as to permit coupling of the bridge sections.

This type of vehicle is disclosed in German Laid-Open Application DE-OS 29 29 208. This vehicle is provided at its forward end with a laying device for moving and laying a bridge which is assembled on the vehicle, and at its tail end it is provided with a pick-up device configured as a pivotable arm, which picks up a section or component of the bridge from a bridge transport vehicle and attaches it to the bridge components which have already been assembled. In order for the just advanced bridge component not to have to be moved forward in alignment with the already assembled bridge components, the pick-up device is provided with a slewing ring which is supported on the vehicle. For coupling the advanced bridge section to the one preceding it, the pick-up device is also arranged so as to be longitudinally displaceable on the vehicle. The number of bridge sections that determine the length of the bridge and can be coupled together with the known vehicle is limited because the assembled bridge sections, which project on one side of the vehicle relatively rapidly produce a tipping moment which exceeds the standing moment of the vehicle.

SUMMARY OF THE INVENTION

It is the object of the invention to configure a vehicle of the type mentioned above, which makes it possible to assemble a significantly longer bridge. The solution of this problem is to design the pick-up device and space it from the laying device so that it is able to take hold of at least one of the bridge sections which form the bridge in a coupled state and displace them relative to the pick-up device in the longitudinal direction of the vehicle a distance which permits at least one bridge section to be inserted between the bridge sections held by the laying device and the bridge sections held by the pick-up device.

Due to the novel configuration of the vehicle, the construction of significantly longer bridges is achieved without the vehicle having to be made heavier or having to be equipped with special supporting devices. A nearly symmetric assembly of the bridge is made possible starting from the center of the vehicle so that during assembly a tipping moment about the center of the vehicle can be totally eliminated or at least be kept to a minimum.

Under normal circumstances the vehicle is equipped with a drive and it may be a track-laying vehicle or wheeled vehicle, and special designs may be considered such as, for example, the motor vehicle provided with a sliding frame according to European Patent Application EP-OS 00 93 873.

In addition, the vehicle serves, preferably simultaneously, in a known manner, for transporting bridge components, with the two ramp sections of a dismountable fixed bridge being of primary interest. These sections then form the shortest bridge unit, which, if required, may be elongated as desired within the scope of the carrying capacity of the vehicle by means of further insertable bridge sections.

Transportation of still more bridge sections on the vehicle depends, above all, on the respectively possible and permissible exterior dimensions. For bridges having uniformly long bridge sections, these sections generally have a length from 6 to 8 m, so that the distance between the laying device and the pick-up device is selected accordingly.

BRIEF DESCRIPTION OF THE DRAWINGS

Embodiments of the invention are shown schematically in the drawing figures and are described below in greater detail with reference thereto.

DESCRIPTION OF THE PREFERRED EMBODIMENTS

Figure 1:
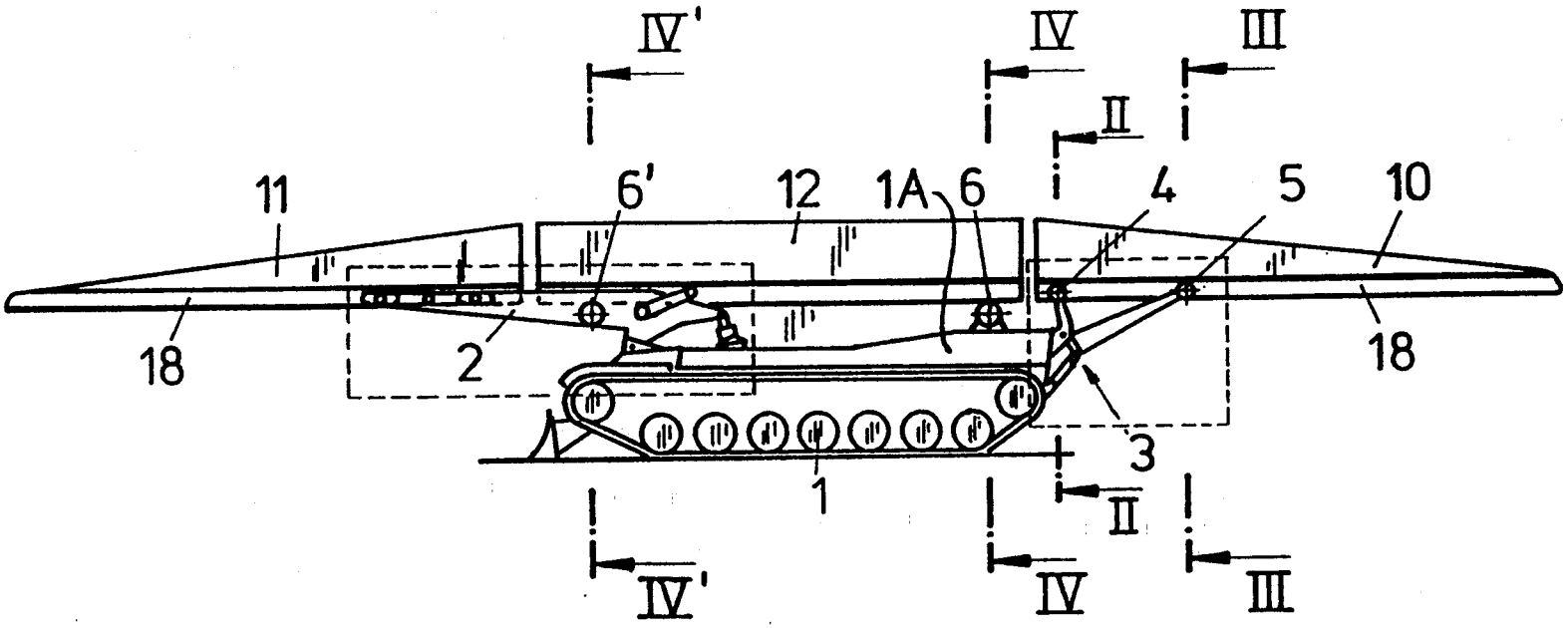
FIG. 1, a front view of a vehicle according to the invention provided with a chain drive.
Figure 4:
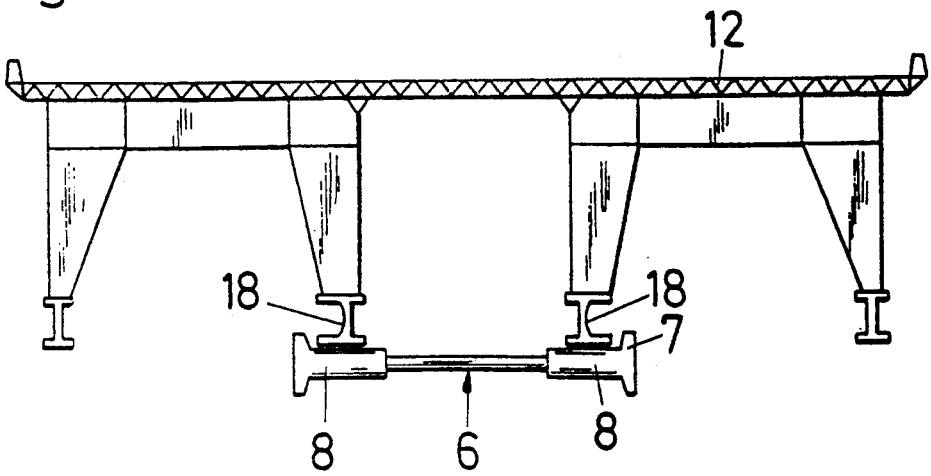

The vehicle 1 has a body 1A on which shown in FIG. 1 is provided at its front end with a projecting laying device 2 that is pivotable about a horizontal axis and serves, in a known manner, to pick up, displace and lay the bridge. On rear end of the vehicle body 1A is provided a projecting pick-up device 3 which is provided with four coaxial carrier rollers 4 and 5, which, in their normal position, lie in pairs in a horizontal plane. A positioning device 6 arranged near the rear end of vehicle body 1A is associated with the pick-up device 3. This positioning device is provided with two coaxially disposed, horizontally displaceable supporting rollers 8 which are each provided with an exterior slewing ring 7 (FIG. 4). A positioning device 6' designed the same way is arranged on the laying device 2.

FIG. 1 shows three bridge sections, two of which are ramp sections. One of the two ramp sections, designated by reference numeral 10, is held by pick-up device 3, while the other ramp section 11 of the bridge is held in alignment with ramp section 10 by the laying device 2.

Figure 5A:
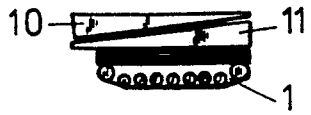
FIGS. 5*a*–5*f*, respectively illustrating the first through sixth steps of a six-step assembly of a bridge on the vehicle according to FIG. 1.

Between the facing ends of ramp sections 10 and 11 is a space sufficient for inserting a bridge section 12. The gap between the ramp and the bridge section subsequent to insertion is approximately 20 cm in each case. The bridge section 12, which is inserted by means of a vehicle or a crane, is placed with its opposite ends on the positioning devices 6 and 6', in such a way that the undersides of all three sections are flush with one another. Then ramp section 11 is moved by means of the displacement drive of the laying device 2 in the direction of bridge section 12 for coupling. If necessary, the bridge section can be temporarily fixed for this purpose. Subsequent to coupling, sections 11 and 12, which were coupled to one another by means of laying device 2, are pushed outwardly until the position shown in FIG. 5*c* is attained, and then a further bridge section 13 can be inserted into the space formed between bridge section 12 and ramp section 10. Section 13 is then coupled with ramp section 10 by moving sections 11 and 12, and is then advanced by means of the pick-up device 3 into the projecting position shown in FIG. 5*d*. Then the last bridge section 14 is inserted and is coupled to the two adjacent bridge sections 12 and 13 by displacing it in the same manner (FIG. 5*e*).

Figure 5B:
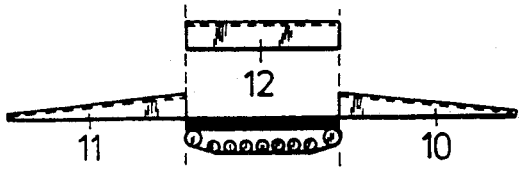
Figure 5C:
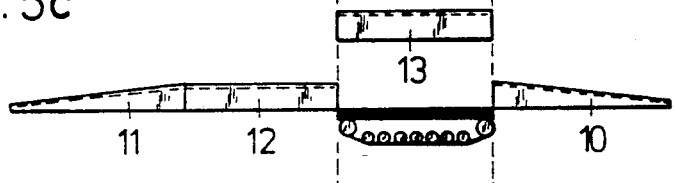
Figure 5D:
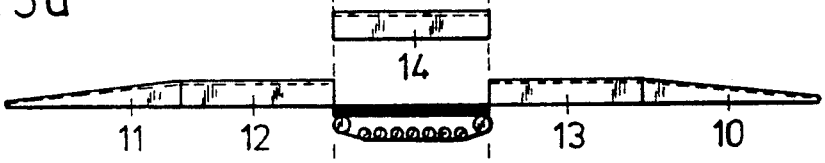
Figure 5E:
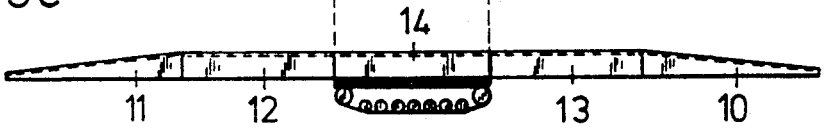
Figure 5F:
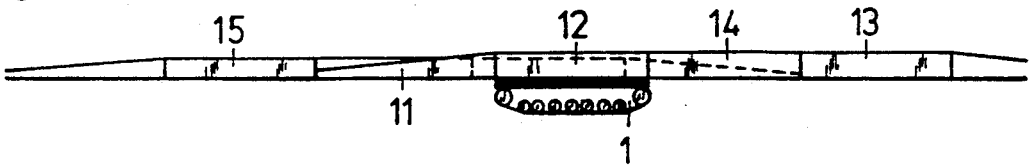
Figure 7:
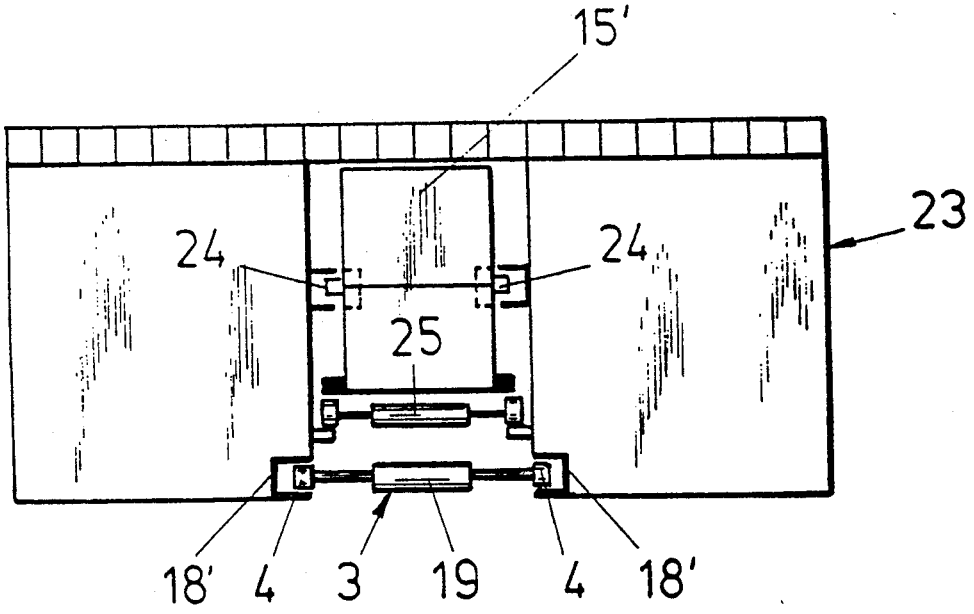
FIG. 7, a cross-sectional view of a bridge section provided with a cantilever support segment.

FIG. 5*f* shows the assembled bridge in a position moved —with respect to the laying direction—toward the rear, with a cantilever support 15 being pushed toward the front. The advancing movement of the cantilever support and the backward movement of the bridge occurs simultaneously in such a way that the resulting tipping moment is at least approximately balanced out. The cantilever support which is divided into sections of equal length to the bridge sections, is longitudinally displaceably disposed inside the bridge as shown in FIG. 7. FIG. 5*a* shows the vehicle 1 in its transporting state, with the two ramp sections 10 and 11 being stacked on top of one another. From this position, they are moved apart in a known manner so that their undersides are aligned with one another and they are then brought into the position shown in FIG. 5*b*.

Figures 6A, 6B, 6C, 6D, 6E, 6F, 6G, 6H:
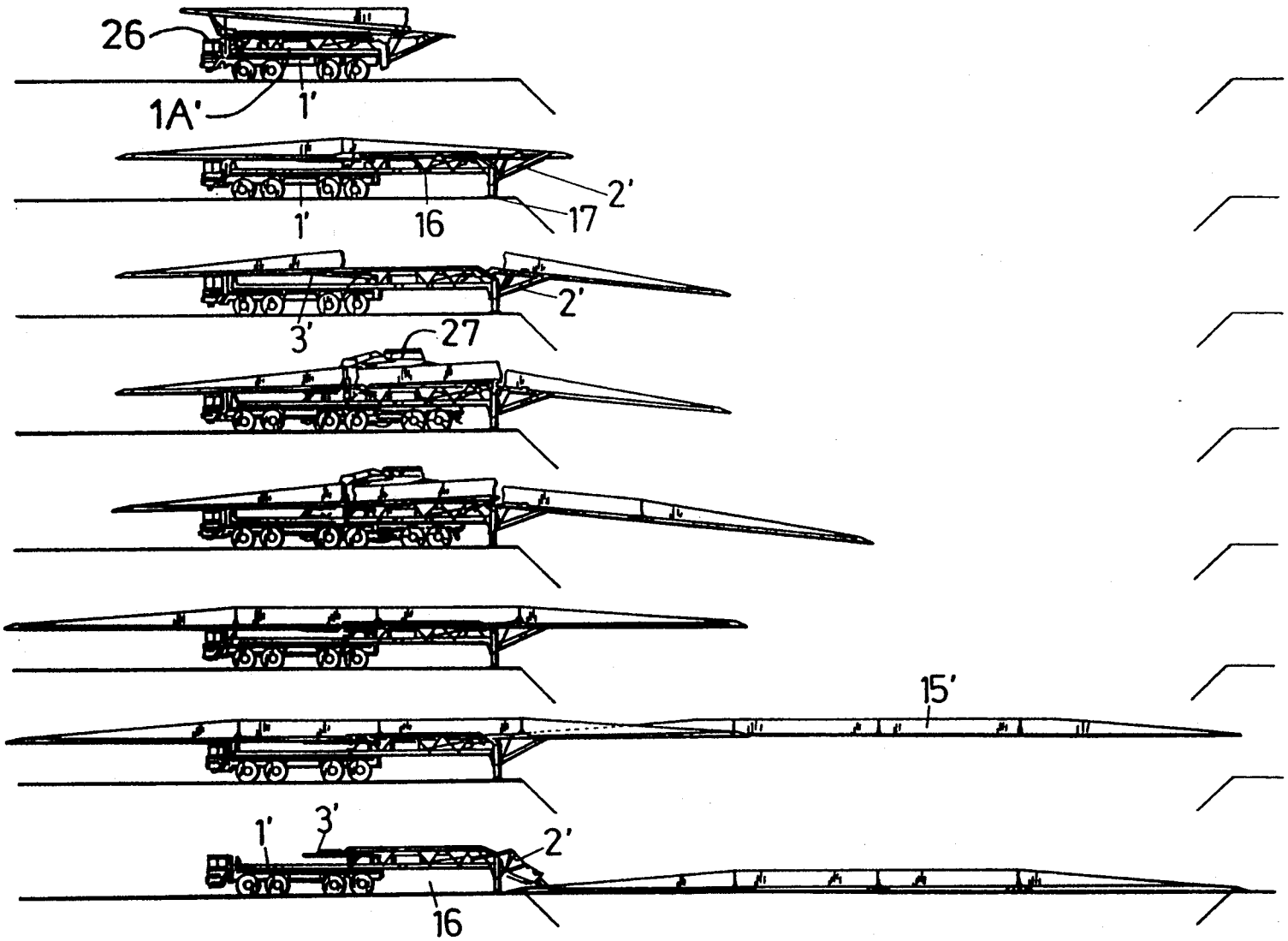
FIGS. 6*a*–6*h* respectively illustrating the first through eighth steps of an eight-step assembly and laying of a bridge on a vehicle provided with a sliding frame.

In the embodiment according to FIGS. 6*a*–6*h* a wheeled vehicle 1' is provided with a sliding frame 16 on it body 1A. In its transporting state (FIG. 6*a*) this vehicle also carries two ramp sections which are stacked on top of one another. Subsequent to moving the sliding frame 16 to beyond the rearward end of wheeled vehicle body 1A, the free end of the sliding frame is supported on the ground by means of a telescoping support 17. The laying device 2' which projects even further and which, as shown in FIG. 6*c*, carries one of the ramp sections in its extended state, is also disposed at this end. The other ramp section is extended toward the opposite end, is held by pick-up device 3', and is supported on the roof of the driver's cab 26 by means of guide rollers which relieve pick-up device 3' of its load. Pick-up device 3' is arranged so as to project on the vehicle body side of the sliding frame 16 and, in its retracted state, the sliding frame 16 is disposed above the driver's cab 26 of vehicle 1'.

The assembly step shown in FIGS. 6*c* and 6*d* corresponds to that of FIG. 5*b*. The subsequent assembly of the bridge is performed in the same sequence as described for FIGS. 5*a*–5*f*. In contrast to the embodiment according to FIGS. 5*a*–5*f*, the coupling of the bridge sections, however, is the result of pivoting the laying device 2' up to the aligned position of the bridge sections, with the couplings being configured appropriately.

FIG. 6*g* shows the cantilever support 15' which is extended to the opposite bank, and FIG. 6*h* shows the bridge completely deployed across the barrier with the aid of the laying device 2'. The cantilever support 15', in this case, remains within the bridge and makes it possible, since it is of equal length with the bridge, to pick the bridge up again and disassemble it from the near as well as the far bank in reverse sequence. In the embodiment according to FIGS. 6*a*–6*h*, the ramp sections (FIG. 6*a*) transported by means of vehicle 1' are longer than the bridge sections used for elongating the bridge by means of a vehicle crane 27. The length of the bridge and of the ramp sections is freely selectable, depending on the respective requirements, but is advisably primarily determined by the transporting capacity of the vehicles used for transport. The width of the bridge is as a rule approximately 4 m.

Figure 2:
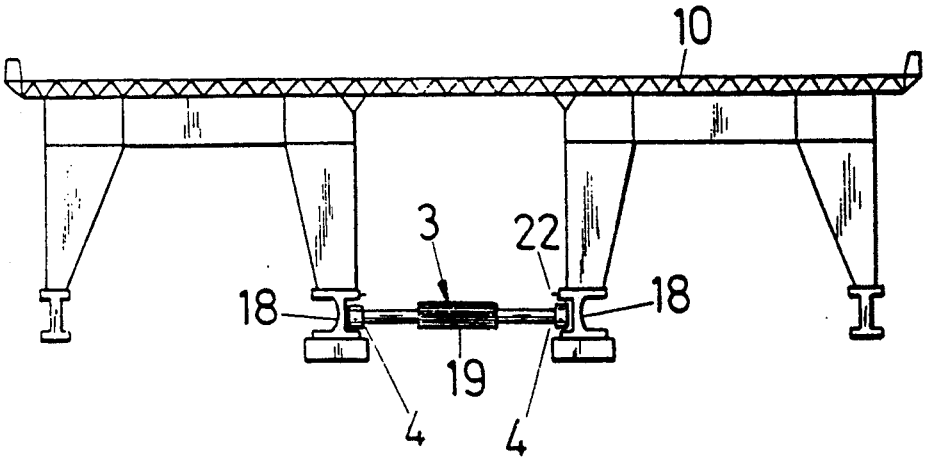
FIGS. 2–4, sectional views respectively along lines II-II, III—III and IV—IV in FIG. 1 in the region of the bridge sections.
Figure 3:
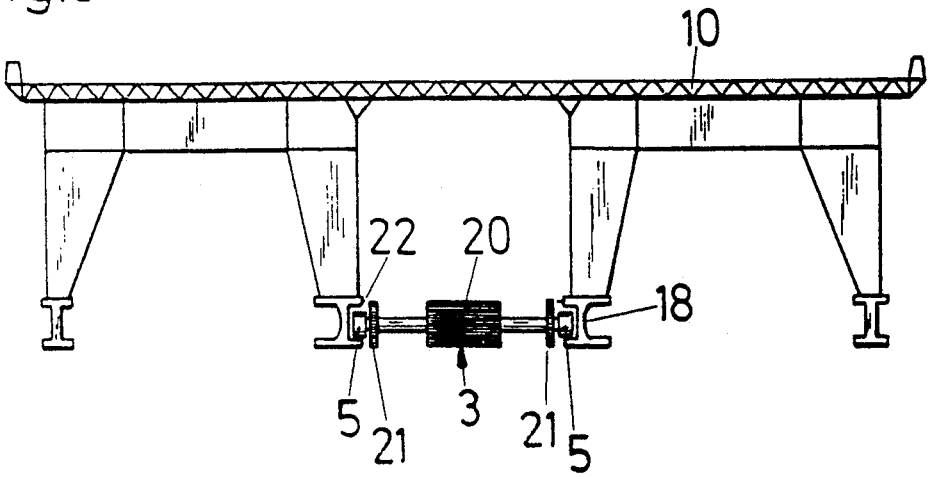

FIGS. 2 and 3 show how the carrier rollers 4 and 5 of the pick-up device 3 engage the U-shaped recesses provided on the track carriers 18, which form the interior bottom chords of the U-shaped tracks of the bridge sections. The rollers 4 are axially adjustable by means of a drive 19 which allows them to be drawn in and out in relation to the track carriers 18. This facilitates insertion of ramp section 10 into the pick-up device 3. The pick-up device 3 is further equipped with a drive 20 which acts on two pinions 21 that are arranged to be coaxial with the carrier rollers 5, which engage the track carriers 18 as well. The pinions 21 engage toothed rods 22 which are arranged to face one another on the interiors of the track carriers 18 so that the drive 20 causes the longitudinal displacement of the bridge sections which are, if necessary, coupled to one another. A corresponding drive is provided in a known manner for the laying device 2.

The support rollers 8 shown in FIG. 4, which are associated with positioning device 6, are each provided with a drive which affects their displaceability in the axial direction. This makes it possible, subsequent to placement of the bridge sections intended to be inserted, for the two support rollers 8, which are initially positioned at greater distances from one another, to be brought into the desired position, i.e., into alignment with the remaining bridge sections, by moving the rollers toward one another by means of the slewing rings 7. For the same purpose, the positioning device 6' arranged at the laying device 2 is configured in the same way.

FIG. 7 shows a cantilever support segment 15' arranged in the center of a bridge section 23. The configuration of this cantilever support segment has already been disclosed in German Laid-Open Patent Application DE-OS 36 28 273. The carrier rollers 4 associated with the pick-up device 3 again engage the track carriers 18' of bridge section 23. The cantilever support 15' is mounted in a corresponding manner to be longitudinally displaceable by means of the guide rollers 24, within the bridge section. A drive 25 disposed at the laying device 2 or at the pick-up device 3 makes it possible to alternatively displace the bridge section or the cantilever support. However, the new vehicle also permits the use of other types of cantilever supports that are displaceable from within the bridge.

For coupling the individual bridge sections and also the cantilever support segments, automatic engagement couplings are used which are released again if the bridge is dismantled. However, the release of the couplings is used advantageously during assembly as well; that is to say, it is used if only the laying device is equipped with a drive for displacing the bridge and if, subsequent to coupling an inserted bridge section at both ends, one end must be released again to separate the respective bridge halves from one another. The couplings may also be configured in such a way that they simultaneously serve as positioning devices, for example, in their simplest embodiment, as a mandrel which can be inserted into a bore from above.

In some cases, for example, if no cantilever support is used, the pick-up device 3 need only be configured in such a way that it can carry half of the maximum number of bridge sections provided for the finished bridge. In case the pick-up device should simultaneously serve as a laying device it must, of course, be designed and configured accordingly. In that cases, the vehicle is even more versatile: for example, the bridge may be picked up again from the far bank without turning the vehicle around.

In individual cases, it is also possible to insert several correspondingly shorter bridge sections which have previously been coupled together without this requiring any modifications. If essentially shorter bridge sections must be inserted individually, the positioning devices are to be arranged at considerably shorter distances from one another or at least one additional positioning device must be used.

I claim:

1. In a vehicle for laying movable bridges, including a laying device, disposed at one end of the vehicle, for displacing and laying a bridge which includes bridge sections that can be assembled on the vehicle, and a pick-up device, disposed at a position on the vehicle which is spaced from said laying device in a longitudinal direction of the vehicle, for picking up and supporting a bridge section so as to permit coupling of bridge sections at the same height with respect to said laying device, the improvement wherein said pick-up device has means for supporting a plurality of the bridge sections when said plurality of the bridge sections are in a coupled state, such that the plurality of coupled bridge sections are displaceable relative to said supporting means away from the laying device in the longitudinal direction; and said pick-up device is spaced from said laying device in the longitudinal direction a distance which is dimensioned so that at least one bridge section can be inserted between bridge sections supported by said laying device and said pick-up device.

2. Vehicle according to claim 1, further comprising a plurality of positioning devices, the laying device and the pick-up device being each associated with at least one positioning device.

3. Vehicle according to claim 2, wherein at least one of the positioning devices is arranged on the associated laying or pick-up device.

4. In combination, the vehicle according to claim 3, and a plurality of bridge sections, the bridge sections having couplings for connecting the bridge sections together, the couplings being configured to form positioning devices.

5. Vehicle according to claim 2, wherein the bridge sections have track carriers on undersides thereof and at least one of the positioning devices includes two spaced apart, coaxially arranged supporting rollers (8) for receiving the track carriers.

6. Vehicle according to claim 5, wherein the supporting rollers are provided with slewing rings and are axially displaceable.

7. Vehicle according to claim 1, wherein the one end of the vehicle is a first end and the pick-up device projects in relation to a second end of the vehicle opposite to said first end.

8. Vehicle according to claim 7, wherein the pick-up device has means for laying the bridge from the second end.

9. Vehicle according to claim 1, wherein the pick-up device and the laying device are each provided with a drive for displacing the bridge sections.

10. In combination, a vehicle for laying a bridge according to claim 1, and a plurality of cantilever support segments having a same length as the bridge sections and which can be held with the bridge sections and simultaneously coupled together when said bridge sections are coupled together.

11. A vehicle for assembling and laying a movable bridge formed of bridge sections coupled end-to-end, the vehicle comprising:

a vehicle body which extends in a longitudinal direction;

a laying device located at an end of said body, said laying device having means for supporting a bridge section at a predetermined height at said end, for moving the supported bridge section, and any further bridge sections coupled thereto, in the longitudinal direction, and for laying the assembled bridge; and a pick-up device disposed on said vehicle body, said pick-up device having means for picking up at least one bridge section, and for supporting a plurality of coupled bridge sections at the predetermined height, so that the coupled bridge sections are longitudinally slideable away from said end and relative to said pick-up device, said pick-up device being spaced from said laying device in the longitudinal direction a distance which is dimensioned so that at least one bridge section can be inserted between bridge sections supported by said laying device and said pick-up device.

12. A vehicle according to claim 11, further comprising at least one first positioning means associated with said laying device, said first positioning means positioning the bridge sections supported by said laying device for mutual coupling, and at least one second positioning means associated with said pick-up device, said second positioning means positioning the bridge sections supported by said pick-up device for mutual coupling.

13. A vehicle according to claim 12, wherein at least one of the first and second positioning means is located on the associated device.

14. A vehicle according to claim 11, wherein at least one of the positioning devices includes two spaced apart coaxial supporting rollers for receiving track carriers on respective undersides of the bridge sections.

15. A vehicle according to claim 14, wherein each of said rollers is axially displaceable and includes a slewing ring.

16. A vehicle according to claim 11, wherein said end of said vehicle body is a first end, said body having a second end opposite said first end, said pick-up device projecting from said second end away from said first end in the longitudinal direction.

17. A vehicle according to claim 16, wherein said pick-up device includes means for setting the coupled bridge sections down from the vehicle, so as to function as a further laying device.

18. A vehicle according to claim 11, wherein each of said pick-up device and said laying device comprises a respective drive for displacing the bridge sections.

19. A vehicle according to claim 11, further comprising a frame slidably mounted on said vehicle body for movement in the longitudinal direction, said laying device and said pick-up device being mounted on respective opposite ends of said frame.

* * * * *